United States Patent [19]

Crenshaw

[11] 4,254,730

[45] Mar. 10, 1981

[54] ANCHORING APPARATUS

[76] Inventor: William S. Crenshaw, P.O. Box 5575, Sun City Center, Fla. 33570

[21] Appl. No.: 56,437

[22] Filed: Jul. 11, 1979

[51] Int. Cl.[3] ..... B63B 21/24

[52] U.S. Cl. ..... 114/294; 114/44; 405/208

[58] Field of Search ..... 114/293, 294, 295, 44, 114/126; 405/203, 208; 115/9; 37/73; 9/1.2; 254/86 H, 93 VA; 244/102 R

[56] References Cited

U.S. PATENT DOCUMENTS

| | | | |
|---|---|---|---|
| 331,460 | 12/1885 | Suckow | 114/44 |
| 1,149,114 | 3/1915 | Carlock, Jr. | 254/86 H |
| 2,443,209 | 6/1948 | Thornburg | 254/86 H |
| 2,945,652 | 7/1960 | Dupree | 244/102 R |
| 3,479,828 | 11/1969 | Luque | 37/73 X |
| 4,070,978 | 1/1978 | Virgilo | 9/1.2 |

FOREIGN PATENT DOCUMENTS

| | | | |
|---|---|---|---|
| 1458259 | 11/1966 | France | 37/73 |

*Primary Examiner*—Sherman D. Basinger
*Attorney, Agent, or Firm*—Arthur W. Fisher, III

[57] ABSTRACT

An anchor apparatus to anchor houseboats or similar water craft comprising at least one retractable anchor element selectively movable between an upper or travel position and a lower or anchor position affixed to the houseboat having a swivel pad specifically configured to anchor the houseboat coupled to the lower portion thereof and a control device operatively coupled to the retractable anchoring element to control the vertical extension and retraction of the retractable anchor element to selectively extend the retractable anchor element downward relative to the houseboat to imbed the swivel pad in the bottom thereby anchoring the houseboat and to retract the retractable anchor element upward relative to the houseboat to permit normal travel of the houseboat.

4 Claims, 2 Drawing Figures

ANCHORING APPARATUS

BACKGROUND OF THE INVENTION

1. Field of the Invention

An anchor apparatus to anchor houseboats or similar water craft.

2. Description of the Prior Art

Houseboats are generally moored or anchored when not underway. When traveling from location to location mooring sites are not available. Thus it is necessary to anchor the houseboat. Unfortunately use of existing anchors often permits drifting. Moreover shallow draft water craft roll and pitch when anchored. This movement may become sufficiently great to cause discomfort and even sickness.

Various devices to jack or lift water crafts have been developed. Typical examples of these efforts are disclosed in U.S. Pat. Nos. 331,460; 856,713 and 2,991,750. However, none of these lends itself for convenient application with a houseboat.

SUMMARY OF THE INVENTION

The present invention relates to an anchor apparatus to anchor houseboats or similar water craft. More specifically, the anchor apparatus comprises four retractable anchor elements disposed within four corresponding anchor housings formed in the hull of the houseboat. A swivel pad specifically configured to anchor the houseboat is pivotally coupled to the lower portion of each retractable anchor element.

Each retractable anchor element comprises a plurality anchor members coupled together in telescoping configuration to permit selective extension and retraction of each retractable anchor element. The anchor apparatus further includes a control means comprising a plurality of control levels and a sensor disposed within each anchor housing to monitor and selectively control the vertical extension and retraction and retractable anchoring element as more fully described hereinafter.

Each swivel pad comprises an upper and lower conical or slanted member coupled together to facilitate anchoring and withdrawal of the swivel pads from the bottom or bed after silt or mud has accumulated on the swivel pads.

Normally each retractable anchor element is fully retracted within its corresponding anchor housing to permit travel or navigation of the houseboat. It should be noted that the anchor apparatus does not extend above the boat deck and create an obstruction as in much of the prior art.

In use, the houseboat is navigated near the bank. Once the houseboat is essentially still in the water, the retractable anchor elements are individually extended downward to engage the bottom or bed. The retractable anchor elements are controlled individually to permit vertical extension to different depths to account for variations in the bottom to securely anchor the houseboat as the individual swivel pads engage the bottom. Moreover, the pivotal mounting of swivel pads permits anchoring firmly on the bottom.

In addition, as can be readily seen, the anchor apparatus may be used to debeach the craft as well as raise the hull above the water for painting and scrapping.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
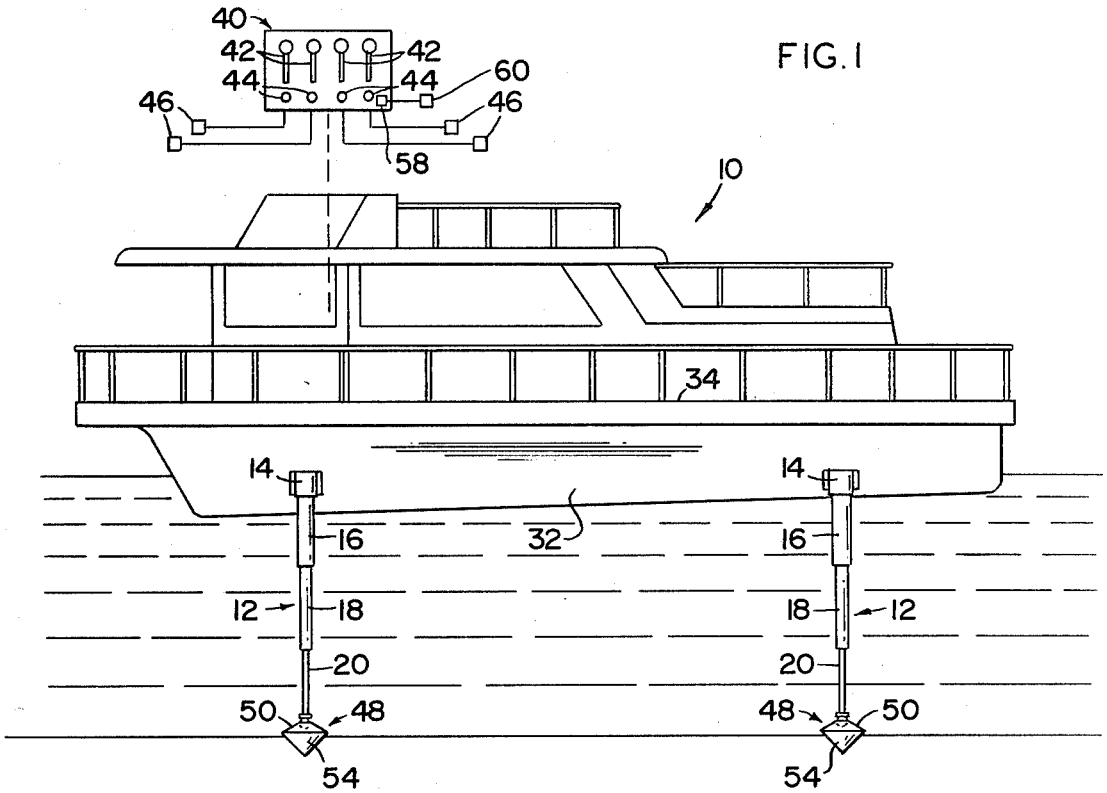
FIG. 1 is a perspective view of the anchor apparatus.
Figure 2:
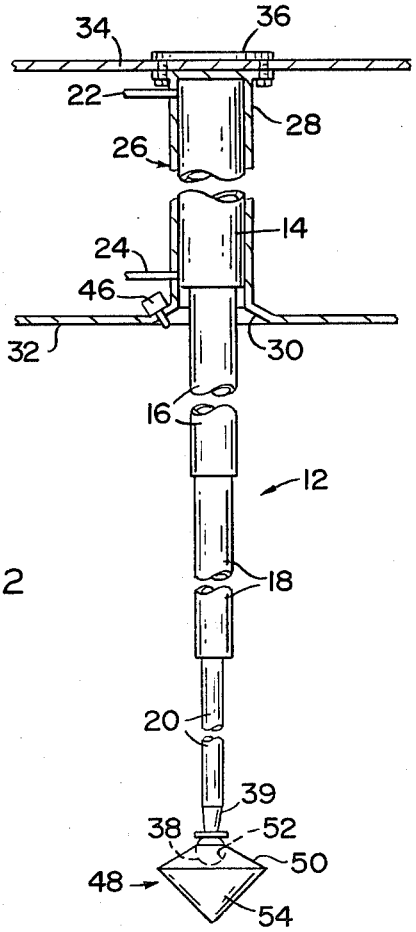
FIG. 2 is a partial detailed view of the anchor apparatus.

As shown in FIGS. 1 and 2, the present invention relates to an anchor apparatus for use with a houseboat generally indicated as 10 or other similar water craft. The anchor apparatus comprises a plurality of retractable anchor elements each generally indicated as 12. Each retractable anchor element 12 comprises a plurality of anchor members 14, 16, 18 and 20 operatively coupled to the next adjacent anchor member in telescoping configuration. Each anchor element 12 is coupled to a hydraulic power source (not shown) by inlet and outlet conduits 22 and 24 respectively to selectively move the anchor elements 12 between an upper or travel position and a lower or anchor position. Each anchor element 12 is disposed with a corresponding anchor housing 26 including an upper cylindrical portion 28 and lower conical recess 30 formed in the hull 32. The upper most anchor member 14 is secured to the deck 34 by a mounting plate 36 while the lower most anchor member 20 includes a spherical coupling member or ball joint 38 formed on the lower reduced portion 39 thereof.

The anchor apparatus further includes a control means comprising a control console 40 including a control lever, control indicator and sensor 42, 44 and 46 respectively corresponding to each anchor element 12.

A swivel pad generally indicated as 48 is pivotally coupled to each spherical coupling member 38. Each swivel pad 48 comprises an upper frustum member 50 including a centrally disposed aperture 52 formed therein and a lower conical member 54 which cooperatively form a hollow body.

Normally each retractable anchor element 12 is fully retracted within its corresponding anchor housing 26 to permit travel or navigation of the houseboat 10. It should be noted that the anchor apparatus does not extend above the boat deck 56 and create an obstruction as in much of the prior art.

In use, the houseboat 10 is navigated near the bank. Once the houseboat 10 is essentially still in the water, the retractable anchor elements 12 are individually extended downward to engage the bottom or bed, by actuating the control levers 42 to hydraulically move the members 16, 18 and 20 under hydraulic pressure through inlet conduit 22. Of course, pneumatic or other such device may be substituted for the hydraulic system. The retractable anchor elements 12 are controlled individually to permit vertical extension to different depths to account for variations in the bottom to securely anchor the houseboat 10 as the individual swivel pads 48 engage the bottom. Moreover the pivotal mounting of swivel pads 48 permits anchoring firmly on the bottom. An alarm system comprising a level sensor or mercury switch 58 and audio generator 60 may be provided to create a position lever indicator.

In addition, as can be readily seen, the anchor apparatus may be used to debeach the craft 10 as well as raise the hull above the water for painting and scrapping. When fully retracted the swivel pads 48 contact the respective sensors 46 causing the respective control indicator 44 to positively indicate the anchor elements 12 are fully retracted with the swivel pads 48 withdrawn into recesses 30. In addition, the apparatus may be used to check for leakage or damage.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An anchor apparatus to anchor houseboats or similar water craft comprising at least one retractable anchor element selectively movable between an upper or travel position and a lower or anchor position affixed to the houseboat, a swivel pad specifically configured to anchor the houseboat coupled to the lower portion of said retractable anchor element and a control device operatively coupled to said retractable anchor element to control the vertical extension and retraction of said retractable anchor element downwardly relative to the houseboat to imbed said swivel pad in the bottom thereby anchoring the houseboat and to retract said retractable anchor element upward relative to the houseboat to permit normal travel of the houseboat when in said upper position, said retractable anchor element comprises at least an upper enlarged member and a lower reduced anchor member operatively coupled to each other, said upper enlarged anchor member coupled to an external power source to selectively move said anchor members in telescoping configuration relative to each other, said retractable anchor element further includes a spherical coupling member formed on a lower reduced portion of said lower anchor member to permit maximum lateral variation of the houseboat relative to said retractable anchor element, said swivel pad comprises an upper frustum member including a central aperture formed therein and a lower conical member to cooperatively form a hollow body to receive said spherical coupling member.

2. The anchor apparatus of claim 1 further including a anchor housing including an upper cylindrical portion and lower conical recess to operatively house said retractable anchor element.

3. The anchor apparatus of claim 2 wherein said control device comprises a control console including a control lever, control indicator and sensor, said sensor disposed within said conical recess to give a control indication when said swivel pad is disposed within said conical recess in the upper or travel position.

4. The anchor apparatus of claim 1 wherein the upper most anchor element is secured to the deck of the houseboat by a mounting plate.

* * * * *